US009172167B2

(12) United States Patent
King, Jr. et al.

(10) Patent No.: US 9,172,167 B2
(45) Date of Patent: Oct. 27, 2015

(54) JUNCTION FAILURE INHIBITING CONNECTOR

(71) Applicants: Lloyd Herbert King, Jr., Chesterfield, MO (US); James C Keeven, O'Fallon, MO (US); William Hiner, O'Fallon, MO (US)

(72) Inventors: Lloyd Herbert King, Jr., Jupiter, FL (US); Michael Belgeri, Ellsville, MO (US); James C Keeven, O'Fallon, MO (US); William Hiner, O'Fallon, MO (US)

(73) Assignee: AL COP LLC, O'Fallon, MO (US)

( * ) Notice: Subject to any disclaimer, the term of this patent is extended or adjusted under 35 U.S.C. 154(b) by 91 days.

(21) Appl. No.: 13/986,411

(22) Filed: Apr. 29, 2013

(65) Prior Publication Data

US 2014/0322994 A1 Oct. 30, 2014

Related U.S. Application Data

(60) Division of application No. 12/313,448, filed on Nov. 20, 2008, now abandoned, which is a continuation of application No. 11/265,392, filed on Nov. 1, 2005, now abandoned.

(60) Provisional application No. 60/629,764, filed on Nov. 20, 2004.

(51) Int. Cl.

| | |
|---|---|
| ***H01R 4/36*** | (2006.01) |
| ***H01R 13/03*** | (2006.01) |
| ***H01R 4/62*** | (2006.01) |
| ***H01R 13/506*** | (2006.01) |

(52) U.S. Cl.

CPC ..... *H01R 13/03* (2013.01); *H01R 4/36* (2013.01); *H01R 4/62* (2013.01); *H01R 13/506* (2013.01); *Y10T 29/49208* (2015.01)

(58) Field of Classification Search

CPC .... H01R 13/03; H01R 23/7073; H01R 43/16; H01R 43/24; H01R 9/24; H01R 9/2491; H01R 4/2429; H01R 4/34; H01R 4/36; H01R 13/5216; H01R 13/5213; H01R 23/025; H01R 4/70; H01R 2201/16; H05K 3/308

USPC ..... 439/814, 709, 810, 886, 521, 936, 475

See application file for complete search history.

(56) References Cited

U.S. PATENT DOCUMENTS

| | | | | | |
|---|---|---|---|---|---|
| 1,849,595 | A | * | 3/1932 | Shaw | 439/830 |
| 2,190,824 | A | * | 2/1940 | Cook | 204/196.2 |
| 2,516,916 | A | * | 8/1950 | Richards et al. | 136/256 |
| 2,740,735 | A | * | 4/1956 | Swain | 148/532 |
| 2,795,770 | A | * | 6/1957 | Toedtman | 439/886 |
| 2,824,819 | A | * | 2/1958 | Smith | 148/285 |
| 3,124,409 | A | * | 3/1964 | Nisula | 439/791 |
| 3,339,174 | A | * | 8/1967 | Walter et al. | 439/793 |

(Continued)

*Primary Examiner* — Abdullah Riyami
*Assistant Examiner* — Vladimir Imas
(74) *Attorney, Agent, or Firm* — Jacobson & Johnson LLC

(57) ABSTRACT

An electrical connector for connecting wires including dissimilar electrical conductors such as copper and aluminum conductors with the electrical connector including failure inhibiting features that can include an oxidation inhibiting coating and a sealant. To ensure that a minimum pressure contact has been achieved at the interface between the electrical connector a shearable fastener can be used to secure an electrical conductor in the electrical connector.

16 Claims, 5 Drawing Sheets

(56) References Cited

U.S. PATENT DOCUMENTS

| | | | | | |
|---|---|---|---|---|---|
| 3,350,677 | A | * | 10/1967 | Daum | 439/587 |
| 3,577,114 | A | * | 5/1971 | Hawkins | 439/277 |
| 3,622,944 | A | * | 11/1971 | Tsuchiya et al. | 439/179 |
| 3,622,946 | A | * | 11/1971 | Rogers | 439/475 |
| 3,629,806 | A | * | 12/1971 | Wiechmann | 439/521 |
| 3,683,331 | A | * | 8/1972 | Overholser | 439/519 |
| 3,836,941 | A | * | 9/1974 | Izraeli | 439/431 |
| 3,864,013 | A | * | 2/1975 | Levy | 439/724 |
| 3,892,459 | A | * | 7/1975 | Dittmann et al. | 439/442 |
| 3,973,824 | A | * | 8/1976 | Chor | 439/877 |
| 3,983,314 | A | * | 9/1976 | Filhaber | 174/138 F |
| 3,989,331 | A | * | 11/1976 | Hanlon | 439/70 |
| 4,097,108 | A | * | 6/1978 | Prodel | 439/475 |
| 4,188,438 | A | * | 2/1980 | Burns | 428/209 |
| 4,189,204 | A | * | 2/1980 | Brown et al. | 439/846 |
| 4,269,465 | A | * | 5/1981 | Mueller | 439/431 |
| 4,315,175 | A | * | 2/1982 | Hamilton et al. | 310/71 |
| 4,447,109 | A | * | 5/1984 | Hobart, Jr. | 439/851 |
| 4,491,496 | A | * | 1/1985 | Laporte et al. | 156/345.47 |
| 4,498,121 | A | * | 2/1985 | Breedis et al. | 361/764 |
| 4,734,061 | A | * | 3/1988 | Randall et al. | 439/709 |
| 5,102,347 | A | * | 4/1992 | Cote et al. | 439/412 |
| 5,186,661 | A | * | 2/1993 | Capper | 439/718 |
| 5,419,714 | A | * | 5/1995 | Nagamine | 439/364 |
| 5,439,759 | A | * | 8/1995 | Lippert et al. | 429/65 |
| 5,533,912 | A | * | 7/1996 | Fillinger et al. | 439/521 |
| 5,626,785 | A | * | 5/1997 | Rajnik et al. | 219/541 |
| 5,690,516 | A | * | 11/1997 | Fillinger | 439/798 |
| 5,848,913 | A | * | 12/1998 | Ashcraft | 439/521 |
| 5,902,156 | A | * | 5/1999 | Geebelen et al. | 439/714 |
| 6,074,240 | A | * | 6/2000 | Bradshaw et al. | 439/412 |
| 6,213,808 | B1 | * | 4/2001 | Whatmore et al. | 439/417 |
| 6,231,405 | B1 | * | 5/2001 | Diconne et al. | 439/812 |
| 6,338,658 | B1 | * | 1/2002 | Sweeney | 439/810 |
| 6,361,381 | B1 | * | 3/2002 | Koebbe | 439/810 |
| 6,497,592 | B1 | * | 12/2002 | Beadle | 439/814 |
| 6,632,108 | B1 | * | 10/2003 | Hohlfelder | 439/709 |
| 6,739,906 | B2 | * | 5/2004 | Lawrence et al. | 439/521 |
| 6,817,910 | B2 | * | 11/2004 | Borgstrom et al. | 439/798 |
| 6,839,428 | B2 | * | 1/2005 | Brower et al. | 379/413.04 |
| 6,854,996 | B2 | * | 2/2005 | Yaworski et al. | 439/276 |
| 6,939,183 | B2 | * | 9/2005 | Ferretti et al. | 439/798 |
| 6,997,759 | B1 | * | 2/2006 | Zahnen et al. | 439/798 |
| 7,037,128 | B2 | * | 5/2006 | Yaworski et al. | 439/276 |
| 7,070,458 | B2 | * | 7/2006 | Axenbock et al. | 439/700 |
| 7,080,451 | B2 | * | 7/2006 | Saito et al. | 29/874 |
| 7,438,603 | B1 | * | 10/2008 | Lewis | 439/709 |
| 7,534,148 | B2 | * | 5/2009 | Schuttler et al. | 439/709 |
| 7,837,517 | B2 | * | 11/2010 | Lewis | 439/709 |
| 7,896,714 | B2 | * | 3/2011 | Moist | 439/793 |
| 8,202,131 | B2 | * | 6/2012 | Battle | 439/796 |
| 8,512,068 | B2 | * | 8/2013 | Gassauer | 439/411 |
| 2004/0072474 | A1 | * | 4/2004 | Nyblin et al. | 439/709 |
| 2004/0121639 | A1 | * | 6/2004 | Yaworski et al. | 439/276 |
| 2006/0155280 | A1 | * | 7/2006 | Siebens et al. | 606/61 |
| 2010/0304590 | A1 | * | 12/2010 | Frassineti et al. | 439/196 |

* cited by examiner

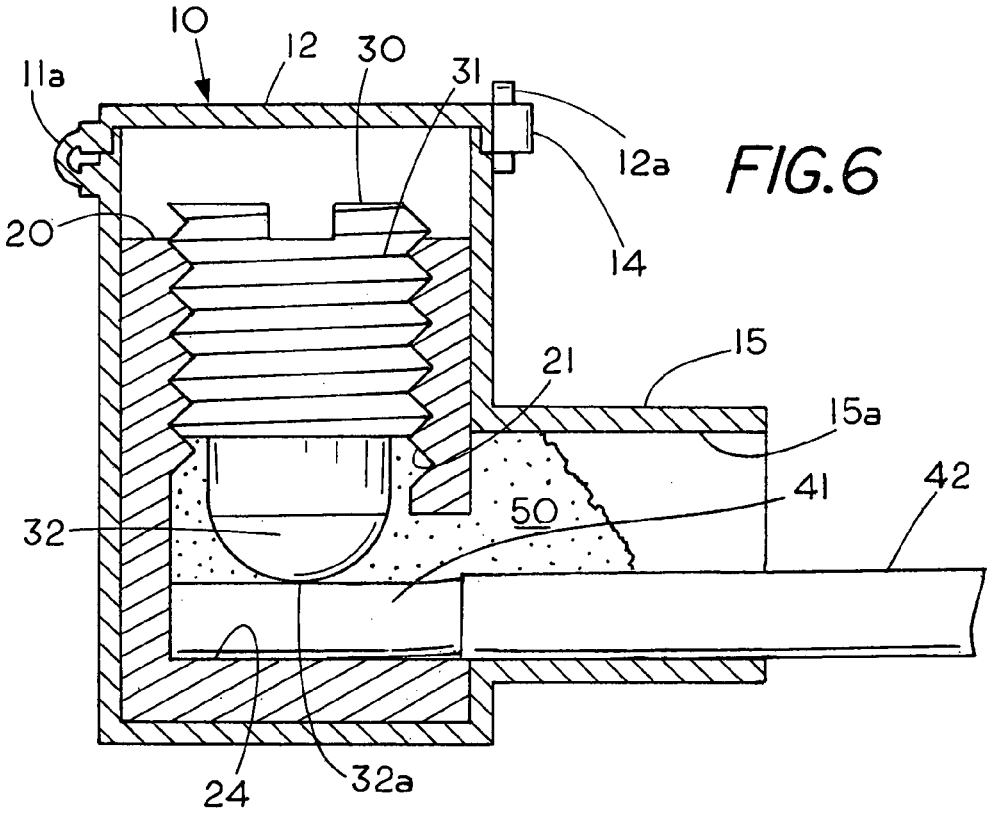
FIG.6
FIG. 7
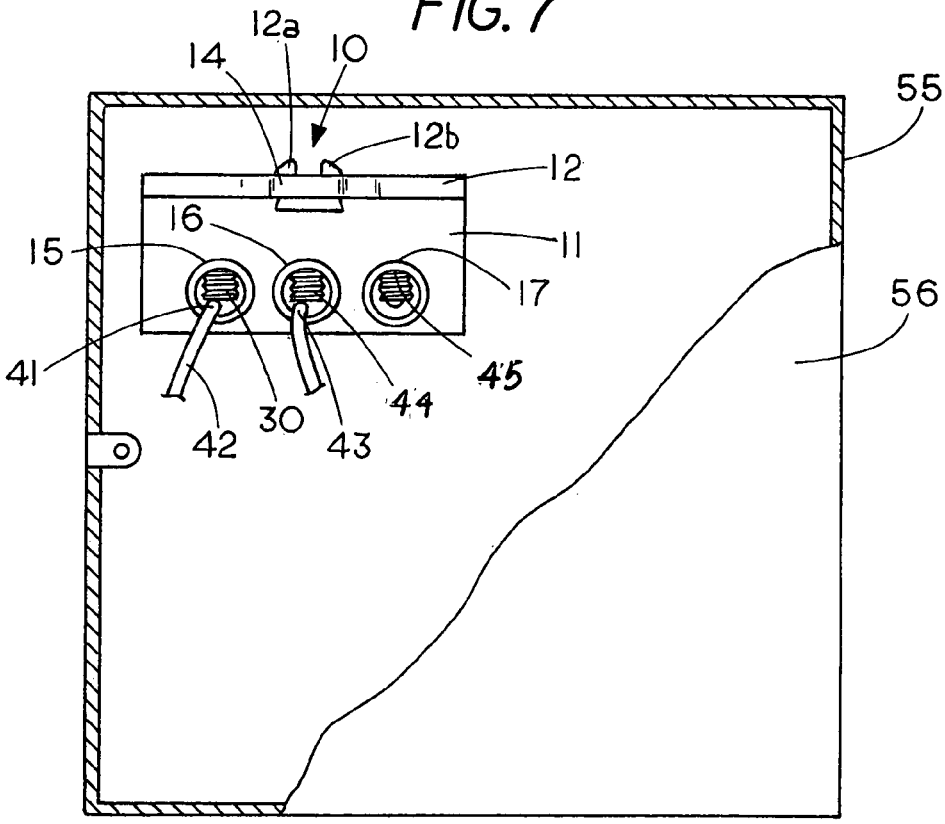

JUNCTION FAILURE INHIBITING CONNECTOR

CROSS REFERENCE TO RELATED APPLICATIONS

This application is a divisional application of Ser. No. 12,313,448 filed Nov. 20, 2008 which is a continuation of application Ser. No. 11/265,392 filed Nov. 1, 2005. titled JUNCTION FAILURE INHIBITING CONNECTOR, which claims the benefit of provisional application 60/629,764; filed Nov. 20, 2004; titled Wire Connector.

FIELD OF THE INVENTION

This invention relates generally to electrical connectors and more specifically electrical connectors that can inhibit or eliminate the deterioration that occurs at an electrical junction of an aluminum conductor.

STATEMENT REGARDING FEDERALLY SPONSORED RESEARCH OR DEVELOPMENT

None

REFERENCE TO A MICROFICHE APPENDIX

None

BACKGROUND OF THE INVENTION

One of the electrical problems with numerous buildings has been the use of aluminum conductors and copper conductors in the same electrical system. Typically, an aluminum conductor is connected directly to the copper conductor through a pressure contact. While such an electrical system can work well for a number of years problems can arise as the electrical system ages.

A number of factors are believed to cause the problems of electrical failure and often fires in electrical junctions in an aluminum/copper electrical wiring system. As aluminum has a higher coefficient of thermal expansion than copper it is believed that the relative expansion between copper conductors and aluminum conductors can lead to loosing of the pressure contact between the conductors resulting in increased resistance which generates heat as the electrical current flows through the high resistance junction.

Another factor is that copper oxidizes over time to form a low resistance electrical conductive layer on the surface of the copper conductor while the oxidation of the aluminum does the opposite, namely, forms an oxidation layer of higher electrical resistance on the surface of the aluminum conductor. The increase resistance due to the presence of an aluminum oxidation layer at the junction between the aluminum and copper generates heat as the current passes therethrough. In addition, because of the different current carrying capacities of aluminum conductors and copper conductors the aluminum conductor in a electrical system may be larger than the copper conductor thus enhancing the connection loosing process as the conductors expand and contract in response to changes in temperature. As a result of various factors as well as the aging of the electrical system conditions arise that can cause fires due to presence of a junction of an aluminum conductor and a copper conductor.

The present invention provides an electrical connector for use in joining aluminum and copper conductors that minimize the occurrence of electrical system failure and the resulting fires. The system can quickly retrofitted to an existing system that uses aluminum and copper wires to thereby remove an electrical fire hazard.

SUMMARY OF THE INVENTION

The present invention comprises an electrical connector suitable for connecting an aluminum conductor through pressure contact with the electrical connector inhibiting or preventing corrosion between interfaces with the aluminum conductor. To inhibit or prevent conditions that can cause failure at the interfaces with the aluminum conductor a coating is placed on the electrical connector. To provide further inhibit or prevent conditions that can cause failure at the interfaces with the aluminum conductor the interface with the aluminum conductor can be covered with a sealant. To isolate the aluminum conductor it can be secured in an electrically conducting terminal block, which is positionable in an electrically insulated housing containing a sealant. To further protect the aluminum conductor interfaces from stress that might increase failure the aluminum conductor can be supported by a portion of the electrically insulated housing.

BRIEF DESCRIPTION OF THE DRAWINGS

FIG. 6 is a sectional view showing a terminal screw engaging an electrical wire located in the terminal block;

FIG. 7 is a cutaway view of an electrical junction box showing the electrical connector located therein;

DESCRIPTION OF THE PREFERRED EMBODIMENT

Figure 1:
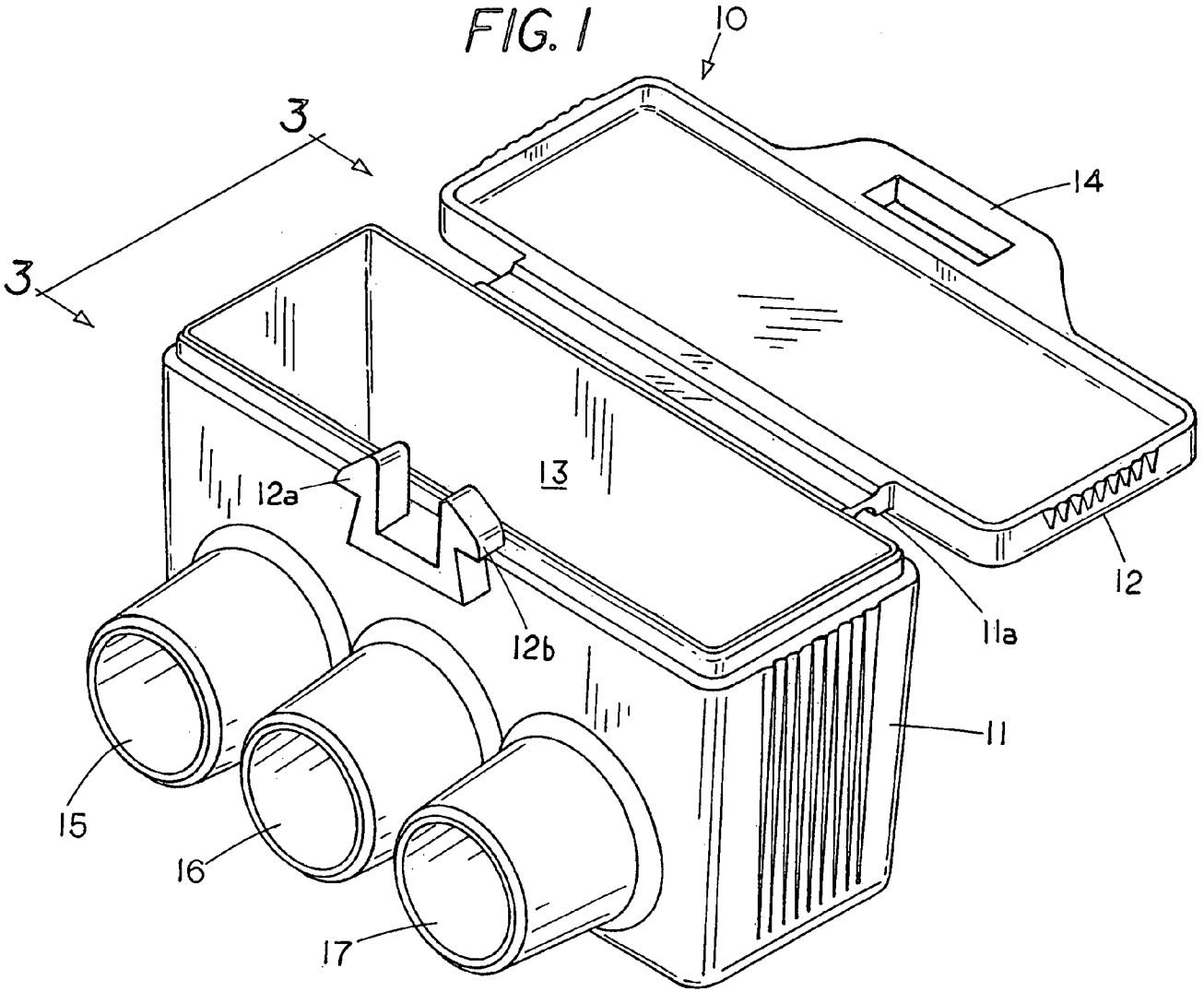
FIG. 1 is a perspective view of a terminal block housing.

FIG. 1 shows a perspective view of a one-piece electrical connector shell 10 comprised of an electrical insulated material and preferably a fire retardant polymer plastic so as to provide a dielectrically safe housing. Shell 10 includes an electrically insulated cover 12 and an electrical insulated housing 11 that contains a terminal block compartment 13 therein. A living hinge 11*a* connects cover 12 to housing 11 to provide reopening of connector shell 10 as needed. A first hook shaped resilient cover latch 12*a* and a second hook shaped resilient cover latch 12*b* extend through the opening in protrusion 14 and lockingly engaging protrusion 14 when the cover 12 is pivoted over housing 11 to form a closed container. The hinged mating of cover 12 with housing 11 produces an electrically insulated protective closure around the terminal block compartment 13.

Extending outward from the front of housing 11 is a first tubular wire inlet or port 15, a second tubular wire inlet or port 16 and a third tubular wire inlet or port 17. Each of the tubular wire inlets provides a wire access passage to the terminal block compartment 13 to increase flashover distance and to provide strain relief by shifting the bending point of a conductor away from an electrical junction or interface of an aluminum connector. When the connector is used with both aluminum and copper conductors the use of one port for each conductor prevents copper and aluminum wires from being connected directly to each other. By connection of each conductor directly to the terminal block one can aid in inhibiting corrosion. While the invention can be used for connection of aluminum conductors to copper conductors it can also be used for connecting aluminum conductors to aluminum conductors and it also can be sized for various conductors. For example, the port can be sized for gauge 12 and 10 solid aluminum conductors. Thus one port could accommodate one size wire and another port accommodate a different size wire, a condition not uncommon in aluminum/copper electrical wiring systems.

Figure 2:
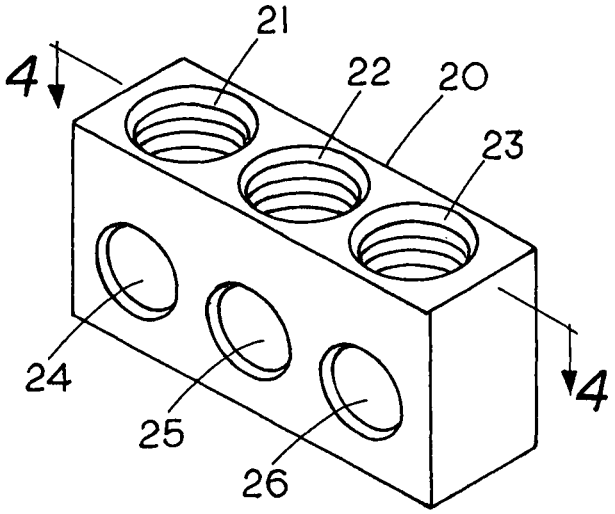
FIG. 2 is a perspective view of a terminal block.
Figure 4:
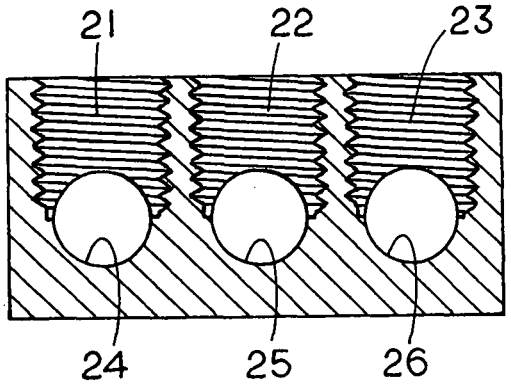
FIG. 4 is a sectional view taken along lines 4-4 of FIG. 2.

FIG. 2 shows a perspective view of a terminal block 20 for forming an electrical connection with an aluminum conductor and FIG. 4 shows a section view of the terminal block 20 taken along lines 4-4 of FIG. 2. Terminal block 20 comprise an electrically conducting material such as aluminum with an oxidation inhibiting coating such as a metal plating. The metal plating on terminal block 20 comprises tin applied in accordance with ASTM 545. Terminal block housing 20 includes a first terminal screw passage 21, a second terminal screw passage 22 and a third terminal screw passage 23 each extending through a top surface 20*a* of the terminal block 20. Extending transverse to the terminal screw passage 21 is a first wire passage 24, extending transverse to the terminal screw passage 22 is a second wire passage 25 and extending transverse to the terminal screw passage 23 is a third wire passage 26. While terminal block 20 with three passages is shown it is envisioned that an integral lug, for example, on an end of a single aluminum conductor could also be used with a pressure fastener to secure a copper conductor thereto.

Figure 3:
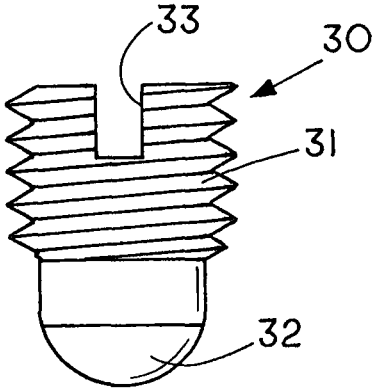
FIG. 3 is an elevation view of a terminal block screw.

FIG. 3 shows an elevation view of a terminal fastener such as an aluminum terminal screw 30 with an oxidation inhibiting coating for rotatingly engaging a threaded passage 21, 22 or 23 in terminal block 20. The oxidation inhibiting coating on the terminal fastener 30 comprises a nickel plate. Terminal screw 30 includes a slotted head 33 for engagement with a conventional blade screwdriver on one end and a domed end 32 on the other end for rotatingly engaging an electrical conductor to form an electrical connection between the conductor and the terminal screw 30 and between a wire passage and the electrical conductor through a pressure contact. The thread size can be selected to provide greater leverage with higher thread density providing greater rotational leverage than lower density threads. The use of a domed head 32 in conjunction with a cylindrical wire passage allows one to form a pressure contact between the terminal screw, the conductor and the wire passage through deformation rather than penetration of the oxide coating on the conductor thereby minimizing or eliminating the opportunity for failure of the electrical connection because of breaching of the oxide layer on the conductor.

Figure 5:
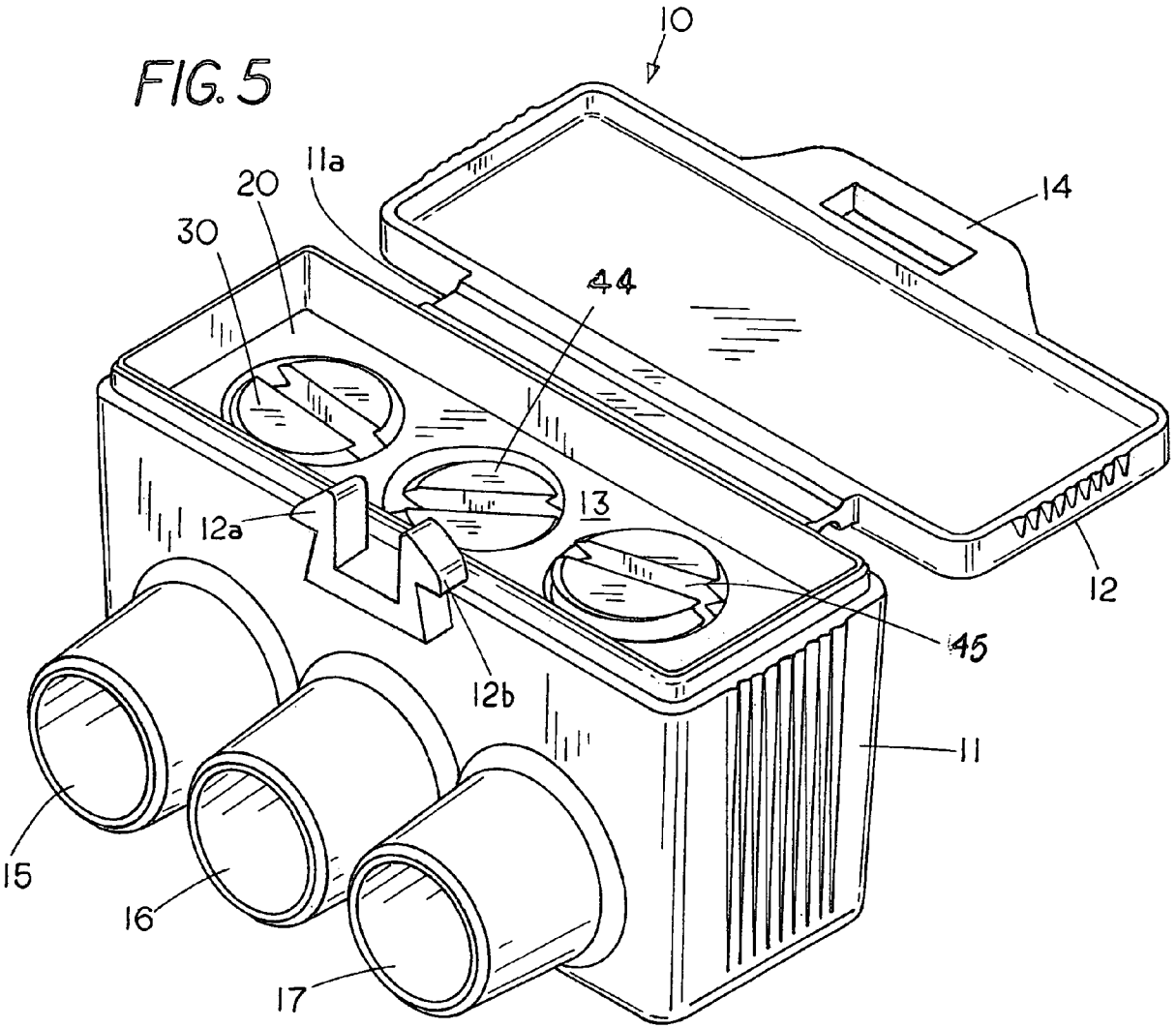
FIG. 5 is a perspective of an electrical connector including the terminal block housing of FIG. 1 with the terminal block of FIG. 2 located therein.

FIG. 5 shows a perspective view of electrical connector shell 10 with the terminal block 20 located in the terminal block compartment 13 in housing 11. In this embodiment the heads on screws 30, 44 and 45 are rotatable by use of a screwdriver when the cover 12 is in the open condition as shown in FIG. 5. When in a closed condition the terminal block 20 which becomes part of the electrical circuit is shielded from accidental contact by the insulated electrical connector shell 10. Thus in the embodiment shown the terminal block or lug 20 is contained in the housing 11.

FIG. 6 shows the electrical connector shell 10 in the closed condition and in section revealing the terminal screw 30 with threads 31 in engagement with threads 21 of terminal block 20. As shown the screw 30 has been rotated into pressure contact with an aluminum conductor 41 that extends into the inlet or port 15. The conductor 41 is squeezed between the bottom of wire passage 24 and screw end 32*a* to form an electrical connection or interfaces with the aluminum conductor. When an aluminum conductor is used with an oxidation inhibiting aluminum terminal block and an oxidation inhibiting aluminum screw the differences in thermal expansion between materials are minimized since the screw, the terminal block and the conductor are all aluminum. However, even though the terminal block and the conductor are aluminum the present invention allows one to form an electrical connection to a non-aluminum conductors such as a copper conductor, since the connector can also work with both aluminum and other metals to thereby enable one to use the connector 10 to connect an aluminum conductor to another non-aluminum conductor such as a copper conductor.

A sealant 50, such as silicone or the like, is shown located over an encapsulating the connections or interfaces between the terminal screw 30 and the terminal wire passage 24 and the exposed conductor 41 for the purposes of inhibiting corrosion or oxidation on the conductor not protected by the insulation covering 42.

The neck 15, which contains a conductor port support surface 15*a*, extends outward to provide support for the electrical conductor 42 and thus relieve stress on the contact region between the screw end 32*a* and the electrical conductor 42.

FIG. 7 shows the electrical connector in the closed condition with the connector shell 10 located in a junction box 55 having a cover 56 with a first conductor 42 extending into electrical contact with screw 30 in the terminal block through port 15 and a second conductor 43 extending into electrical contact with screw 43 through port 16. The third port 17 is in a condition to receive a free end of another electrical conductor, which can be secured to terminal block therein by screw 44.

Figure 8:
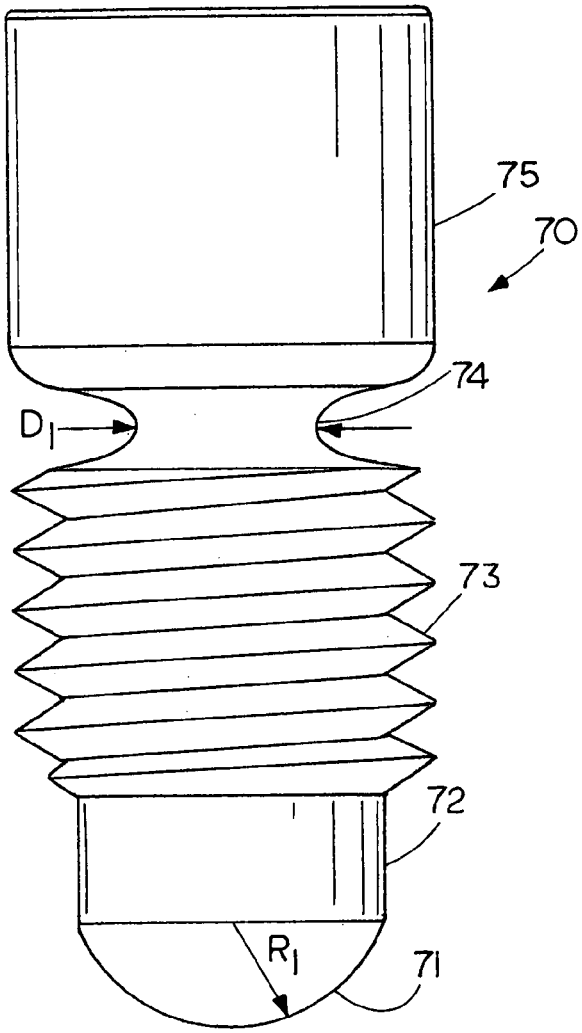
FIG. 8 is an elevation showing a terminal block screw having a weakened section to enable shearing of the screw when a predetermined torque is applied to the screw.

FIG. 8 shows a perspective view of a shearable terminal block screw 70 for use in terminal block 20. The terminal block screw 70 contains a round or hemispherical end 71 having a radius of curvature R.sub.1 and a cylindrical section 72 that mates to the end of threads 73. Located between threads 73 and head 75 is a smaller diameter region or neck 74 that has a diameter D.sub.1 that is less than any diameter of any other section of the screw 70. The purpose of providing a neck is to include a region that can shear when a specified torque is applied to the screw. That is, to provide for a solid electrical connection between the wire and the terminal block a minimum amount of force should be exerted by the end 71 of the terminal block screw against the wire conductor in the passageway in the terminal block. In order to ensure that sufficient contact pressure has been achieved the neck 74 is designed so that when the contact pressure at the end of the screw 70 against the wire conductor is sufficient to ensure a good electrical connection the terminal block screw shears at neck 74. That is, the user tightens the screw 75 by rotating screw 70 until the head 75 shears from the body of the terminal block screw 70. The user then knows the proper contact pressure has been achieved.

Figure 9:
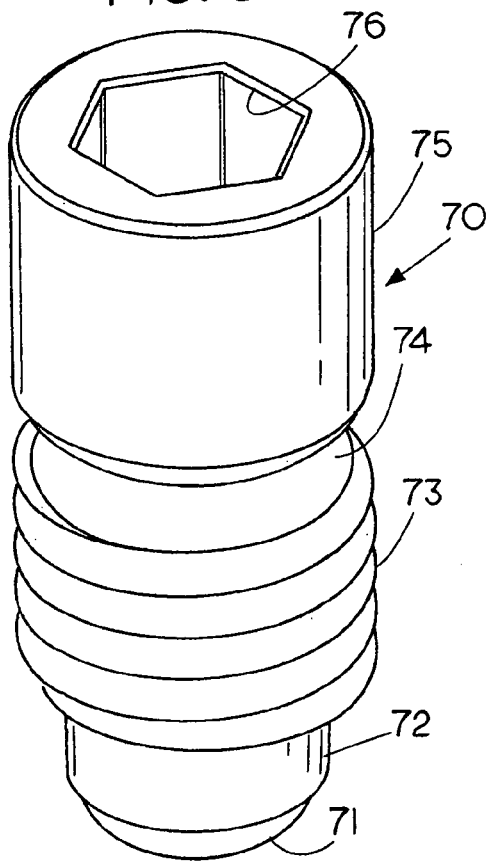
FIG. 9 is a perspective view of a terminal block screw having a hex head.

FIG. 9 shows a perspective view of the fastener of FIG. 8 revealing a hex socket 76 in the head 75 to enable a user to apply a tightening torque with a hex head wrench.

Thus the present invention also includes the method of making an electrical connection in a terminal block wherein a minimum acceptable contact force with the electrical conductor can be achieved with a shearable screw. By having the connection pressure exceed a threshold one can create conditions wherein one obtains a good electrical connection even though dissimilar metal conductors such as aluminum and copper are connected to each other through the terminal block. While the use of a shearable terminal block screw provides for an automatic check on the needed amount of pressure on the conductor other methods of insuring sufficient contact pressure can be used such as a torque wrench. In this case the terminal block screw is tightened until a predetermined torque is reached and hence the desired contact pressure between the terminal block and the wire conductor. It should be understood that terminal block as used herein includes lugs or other types of devices for connecting terminal ends of conductors thereto.

Thus as illustrated in FIG. 6 and FIG. 7 the invention includes the method of making an electrical connection between a first aluminum conductor 41 and a second conductor 43 of a different metal by securing the aluminum conductor 41 to one portion of an electrical conducting terminal block 20 and securing the second conductor to a further portion of the electrical conductor block 20 so that an electrical current will pass from the aluminum conductor 41 to the second conductor 42 through the terminal block 20 and vice versa and covering an interface on the aluminum conductor 41 and on the second conductor 42 to inhibit corrosion.

We claim:

1. An electrical connector for inhibiting oxidation and minimizing the occurrence of electrical system failure and a resulting fire when joining an aluminum conductor and a copper conductor comprising:

an electrical insulated housing;

a first inlet port having a conductor port support surface extending outward;

a terminal block located in said housing with said terminal block having an oxidation inhibiting coating thereon; and a screw fastener having an oxidation inhibiting coating thereon so that when the aluminum electrical conductor is brought into pressure contact with the screw fastener produces an electrical junction between the oxidation inhibiting coating on the terminal block and the oxidation inhibiting coating on the screw fastener to thereby minimize failure of the electrical junction while the conductor port support surface provides support for the aluminum electrical conductor therein.

2. The electrical connector of claim 1 wherein the screw fastener comprises an aluminum shearable terminal screw having a slotted head shearable from a body of the terminal screw in response to rotation thereof to automatically ensure a sufficient pressure contact between the screw fastener and the terminal block.

3. The electrical connector of claim 2 including a sealant located in said terminal block with said sealant extending over an interface between an end of the aluminum electrical conductor and the terminal block and an interface between the aluminum electrical conductor and the fastener.

4. The electrical connector of claim 1 wherein the oxidation inhibiting coating on the terminal block comprises tin and the oxidation inhibiting coating on the screw fastener comprises nickel with the screw fastener including a domed head for deforming an electrical conductor without penetration of an oxidation inhibiting coating on the aluminum electrical connector.

5. The electrical connector of claim 3 wherein the terminal block includes at least three conductor passages with each inlet port having a conducting support surface.

6. The electrical connector of claim 1 wherein the screw fastener comprises a terminal screw having a slotted head and a hemispherical domed head on a conductor-engaging end with a neck located between a head and a domed end with the neck shearing from the body of the terminal screw to let a user know a proper contact pressure has been achieved between the screw fastener and aluminum electrical conductor located therein.

7. The electrical connector of claim 2 wherein the screw fastener includes a neck of smaller diameter region than any other portion of the screw fastener so that the screw fastener can shear at the neck when a shearing torque is applied to the fastener to provide an automatic check on the needed amount of pressure to ensure an electrical connection of needed pressure between the aluminum screw fastener and either an aluminum electrical conductor or a copper electrical conductor.

8. A method of making an electrical connection between a first aluminum conductor and a second conductor of a different metal to minimize the occurrence of an electrical systems failure and a resulting fire comprising steps:

supporting an aluminum conductor in a first conductor supporting passage;

securing the aluminum conductor to one portion of an electrical conducting terminal block with a first screw;

supporting a second conductor in a second conductor supporting passage;

securing the second conductor to a further portion of the electrical conductor block with a second screw so that an electrical current will pass from the aluminum conductor to the second conductor through the terminal block and vice versa;

covering an electrical connection on the first aluminum conductor and an electrical connection on the second conductor with a sealant to inhibit corrosion with the step of securing the aluminum conductor to one portion of an electrical conducting terminal block with a first screw comprises securing the aluminum conductor to one portion of a tin plate on the electrical conducting terminal block and the step of securing the aluminum conductor to one portion of an electrical conducting terminal block with a second screw with the second screw having a nickel plate.

9. The method of claim 8 including the step of connecting a further aluminum conductor to the terminal block.

10. The method of claim 8 including the step of placing the electrically conducting terminal block in an electrical insulating shell.

11. The method of claim 10 including the step of latching a cover to the electrically insulating shell to enclose the electrical conducting terminal block in the electrical insulating shell.

12. The method of claim 8 wherein the step of securing the aluminum conductor to the terminal block comprises using a screwdriver to rotate the first screw fastener into pressure contact with an aluminum conductor until a head of the first screw shears from a body of the first screw and to rotate the second screw fastener into pressure contact with the second conductor until a head of the second screw shears from a body of the second screw.

13. The method of claim 8 including engaging either a slotted head or a hex socket for rotating the first screw until a shear condition is achieved in the first screw to provide an automatic check on the needed amount of pressure to ensure that a minimum pressure contact with the aluminum conductor has been achieved.

14. A method of making an electrical connection between a first aluminum conductor and a second conductor of a different metal to minimize the occurrence of an electrical systems failure and a resulting fire comprising steps:

supporting an aluminum conductor in a first conductor supporting passage;

securing the aluminum conductor to one portion of an electrical conducting terminal block with a first screw;

supporting a second conductor in a second conductor supporting passage;

securing the second conductor to a further portion of the electrical conductor block with a second screw so that an electrical current will pass from the aluminum conductor to the second conductor through the terminal block and vice versa;

covering an electrical connection on the first aluminum conductor and an electrical connection on the second conductor with a sealant to inhibit corrosion where the step of securing the aluminum conductor to one portion of an electrical conducting terminal block with a first screw comprises securing the aluminum conductor to a tin plated surface of the electrical conducting block.

15. The method of claim 14 wherein the step of securing the aluminum conductor to one portion of an electrical conducting terminal block with a first screw comprises securing the aluminum conductor to a nickel plated surface of the first screw.

16. An electrical connector minimize the occurrence of an electrical systems failure and a resulting fire comprising:

a tin plated terminal block having a screw passage and a port for receiving an electrical wire; and a nickel-plated screw fastener for securing to the tin-plated terminal block and to the electrical wire though engagement of the nickel-plated screw fastener with the screw passage in the terminal block.

* * * * *